United States Patent [19]

Kuo

[11] 4,081,643

[45] Mar. 28, 1978

[54] BEARING MEANS FOR A ROTATABLE MEMBER

[75] Inventor: Ted L. C. Kuo, Fanwood, N.J.

[73] Assignee: Thomas & Betts Corporation, Elizabeth, N.J.

[21] Appl. No.: 687,337

[22] Filed: May 17, 1976

[51] Int. Cl.[2] ..... H01H 3/04

[52] U.S. Cl. ..... 200/153 G; 200/335; 308/15

[58] Field of Search ..... 200/153 G, 329, 335, 200/339; 174/55; 308/15, 36, 238

[56] References Cited

U.S. PATENT DOCUMENTS

| | | | |
|---|---|---|---|
| 3,178,530 | 4/1965 | Lawson | 200/335 X |
| 3,582,584 | 6/1971 | Best | 200/295 X |

*Primary Examiner*—J. V. Truhe
*Assistant Examiner*—D. A. Tone
*Attorney, Agent, or Firm*—David Teschner; Jesse Woldman

[57] ABSTRACT

A rotatable member which may comprise a toggle lever for a wiring device is supported by two sets of bearing elements, one set being located on a base and the other set being located on sidewalls integral with the base to provide a self-contained unitary assembly. In one embodiment, the rotatable member may be snapped into position and is simultaneously engaged by both sets of bearing elements in the housing portion of a molded wiring device to provide locational integrity independent of the location of other parts of the wiring device.

10 Claims, 13 Drawing Figures

BEARING MEANS FOR A ROTATABLE MEMBER

BACKGROUND OF THE INVENTION

1. Field of the Invention

The invention is directed to the field of bearing means for rotatable members.

2. Description of the Prior Art

Prior art bearing or pivot supports for rotatable elements are well known and have been employed in various devices which may include rotatable toggle levers for wiring devices and the like. Arrangements which have been designed for use in connection with pivoting switch levers and the like are exemplified in U.S. Pat. No. 2,692,931 issued Oct. 26, 1954 to B. E. Getchell; U.S. Pat. No. 3,134,881 issued May 26, 1964 to D. B. Pawell; and U.S. Pat. No. 3,271,550 issued Sept. 6, 1966 to R. O. Wiley. These devices generally comprise a toggle lever supported solely by bearing elements encompassing the opposing ends of the shaft portion. A deflectable toggle lever shaft arrangement adapted to resiliently deflect inwardly for assembly within bearing openings fixedly located on opposing sidewalls of a wiring device is shown in U.S. Pat. No. 3,701,870 issued Oct. 31, 1972 to R. W. Sorenson. This device, although providing a simpler and more rapid assembly than that provided by the previously mentioned devices, is still limited to a bearing support solely at the ends of the shaft. Further supporting and bearing surfaces are provided in connection with a device disclosed in U.S. Pat. No. 3,178,530 issued Apr. 13, 1965 to G. R. Lawson. However, in the Lawson device, the shaft supporting bearing elements are located in one section of a two part housing assembly while an additional set of bearing elements are located in a cover section which is required to maintain the toggle lever assembly in proper position within the housing. Consequently, removal of the cover results in a total loss of retention of the toggle lever assembly and the elements employed in association therewith so that loss, misplacement, or misalignment of these elements may easily result.

SUMMARY OF THE INVENTION

The invention overcomes the limitations and difficulties noted above with respect to prior art devices by providing a self-contained bearing arrangement for a rotatable member which is more convenient, reliable, and less prone to loss, damage, or misalignment than such prior art devices. The bearing arrangement, which is shown for purposes of example, as employed in connection with a wiring device having a toggle lever, comprises two sets of open bearing elements, one set being located on the base of a wiring device and arranged to support the toggle lever shaft, while the other set is located on spaced, opposing, preferably somewhat resilient sidewalls formed integrally with the base and arranged to engage an enlarged arcuate portion extending normal to and located preferably midspan of the shaft axis of the toggle lever. Assembly of the toggle lever to the housing may be accomplished in a single, rapid, and convenient manner by aligning the toggle lever shaft and arcuate portion over the bearing elements and urging the toggle lever downwardly into the housing causing the sidewall mounted bearing elements to engage the adjacent surface of the arcuate portion as the shaft supporting bearing elements simultaneously engage the respective end portions of the toggle lever shaft. The toggle lever is thus rotatably coupled between the two sets of bearing elements in one part of the two part housing independently of the assembly of the other part thereto. The predetermined shaft and bearing alignment thus remains undisturbed irrespective of the placement or location of the cover part of the housing. The enlarged arcuate portion of the toggle lever may comprise spaced parallel segments suitably proportioned so as to deflect inwardly towards one another, which feature may be employed either independently of, or in conjunction with, the deflectable characteristics of the sidewalls to enhance the assembly of the toggle lever between the two sets of bearing elements. In one embodiment, the bearing elements, base portion, and sidewalls comprise a unitary, integrally molded structure for ease, simplicity, and economy in manufacture. In a further embodiment the sidewall mounted bearing elements are separably attachable to their respective sidewalls for assembly thereto either prior or subsequent to the placement of the rotatable member within the supporting structure. It is therefore an object of this invention to provide an improved bearing arrangement for a rotatable member.

It is another object of this invention to provide an integral bearing assembly for a rotatable member.

It is a further object of this invention to provide a unitary multiple surface bearing structure for a rotatable member.

It is still another object of this invention to provide a rapid and convenient means for assembling a toggle lever member to a wiring device.

It is yet a further object of this invention to provide a snap-in arrangement for assembling a rotatable member to a supporting structure.

It is still a further object of this invention to provide an inexpensive bearing arrangement for retaining a rotatable member within a supporting structure.

It is yet another object of this invention to provide an inexpensive multiple-surface bearing arrangement for a rotatable member permitting a snap-in assembly of the rotatable member within a supporting structure.

It is yet a further object of this invention to provide a multiple surface bearing arrangement for a rotatable member in which selective bearing elements may be placed in position either prior or subsequent to the mounting of the rotatable element within a supporting structure.

It is still another object of this invention to provide a multiple surface bearing arrangement for a rotatable member in which the bearing arrangement is formed as an integral part of a molded supporting structure.

Other objects and features will be pointed out in the following description and claims and illustrated in the accompanying drawings which disclose by way of example the principle of the invention and the best mode contemplated for carrying it out.

BRIEF DESCRIPTION OF THE DRAWINGS

In the Drawings.

Similar elements are given similar reference characters in each of the respective drawings.

DESCRIPTION OF THE PREFERRED EMBODIMENTS

Figure 7:
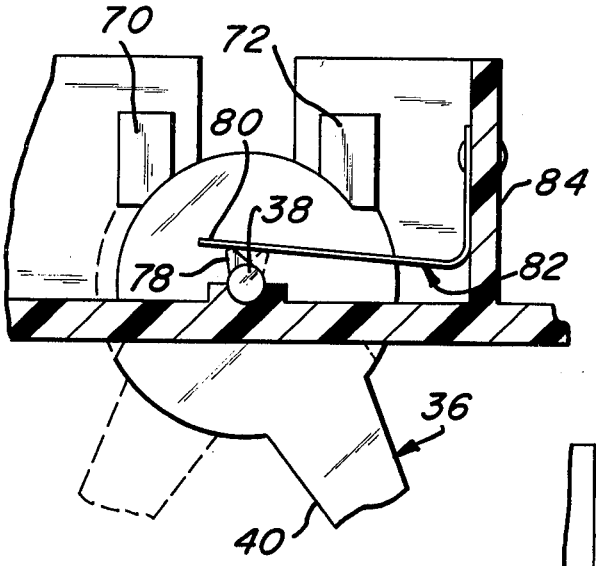
FIG. 7 is a fragmentary side elevational view, partly in section, showing details of a toggle lever mounted in a bearing arrangement constructed in accordance with the concepts of the invention.
Figure 8:
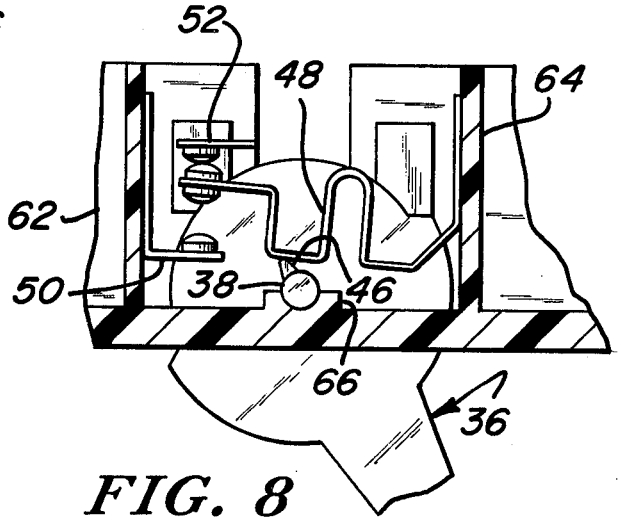
FIG. 8 is a fragmentary side elevational view, partly in section, showing details of a switch actuating toggle lever mounted in a bearing arrangement constructed in accordance with the concepts of the invention.

Turning now to FIGS. 1 through 6 there is shown, for purposes of example, a wiring device 20 which may be conveniently molded from suitable plastic material as an integral unit comprising a generally planar base portion 22 which may also serve as the faceplate of the device 20. The base portion 22 comprises an inner surface 24 having thereon a box-like enclosure 26 defined by a series of walls 28, 30, 32, and 34, respectively. A rotatable member such as the toggle member 36 comprising a shaft portion 38, a handle portion 40 extending outwardly from the shaft portion 38 and through the base portion 22 for manipulating the toggle member 36, and an enlarged centrally located arcuate portion shown as including a pair of spaced arcuate segments 42 and 44, is assembled within the wiring device 20. The toggle member shaft portion 38 includes a cam element 46 which may be employed in the manner shown in FIG. 8 to selectively operate a switch arm 48 operable between a pair of fixed contacts 50 and 52. As further illustrated in FIGS. 1 and 2, the wiring device 20 further includes a series of inner upstanding sidewalls 54, 56, 58, 60, 62, and 64 located within the area encompassed by the outer sidewalls 28, 30, 32, 34 and formed integrally with the base portion 22. Located on the base portion 22 directly adjacent the inner surfaces of the sidewalls 34 and 30 are a pair of first bearing elements 66 and 68 each having an open semicircular recess for receiving and supporting the respective ends of the shaft portion 38. Engaging the arcuate segments 42 and 44 of the toggle member 36 are two pair of second bearing elements comprising bearing elements 70 and 72 (FIG. 2) located on the sidewalls 54 and 58, respectively, and engaging the arcuate segment 42, and bearing elements 74 and 76 (FIG. 2) located on the sidewalls 56 and 60, respectively, and engaging the arcuate segment 44. The respective first and second bearing elements are thus precisely located with respect to one another, thereby avoiding many of the usual problems encountered in instances in which individual bearing surfaces are located on separate parts, leading to excessive tolerance build up and consequential misalignment in the final assembly. Furthermore, the toggle member 36 is securely retained and supported in position within the enclosure 26 independently of the assembly of a cover (not shown) or other separate part thereto. As further illustrated in FIG. 7, the toggle member shaft portion 38 may be provided with a further cam element 78 selectively engaging the foot portion 80 of a spring member 82 coupled to a wall 84 of the wiring device 20. By suitably locating the cam element 78 on the shaft portion 38 relative to the angular position of the toggle member handle portion 40, the toggle member 36 may be retained in either of two positions shown respectively by the solid and dotted outlines in FIG. 7. These positions may be arranged to correspond to the movement of the switch arm 48 (FIG. 8) between the switch contacts 50 and 52 in response to the movement of the cam element 46.

Figure 1:
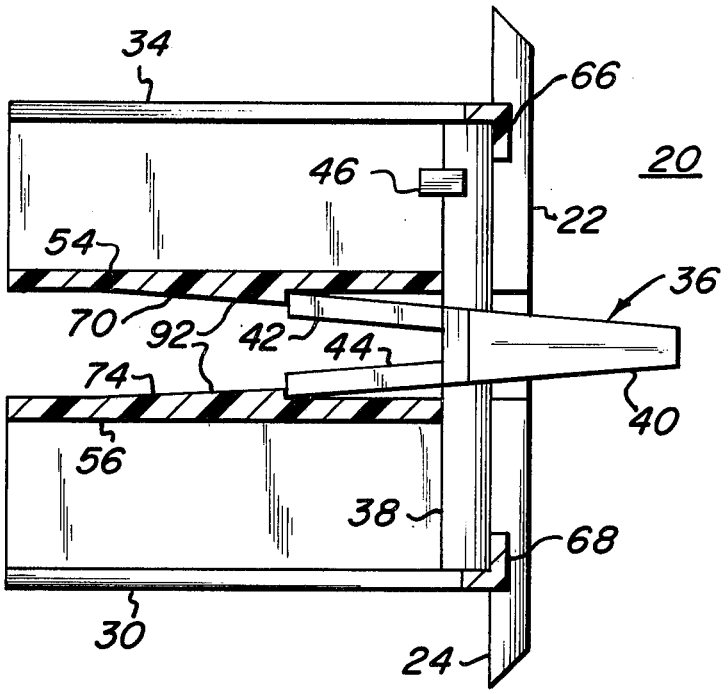
FIG. 1 is a top plan view, partly in section, of a wiring device employing a bearing arrangement constructed in accordance with the concepts of the invention.
Figure 2:
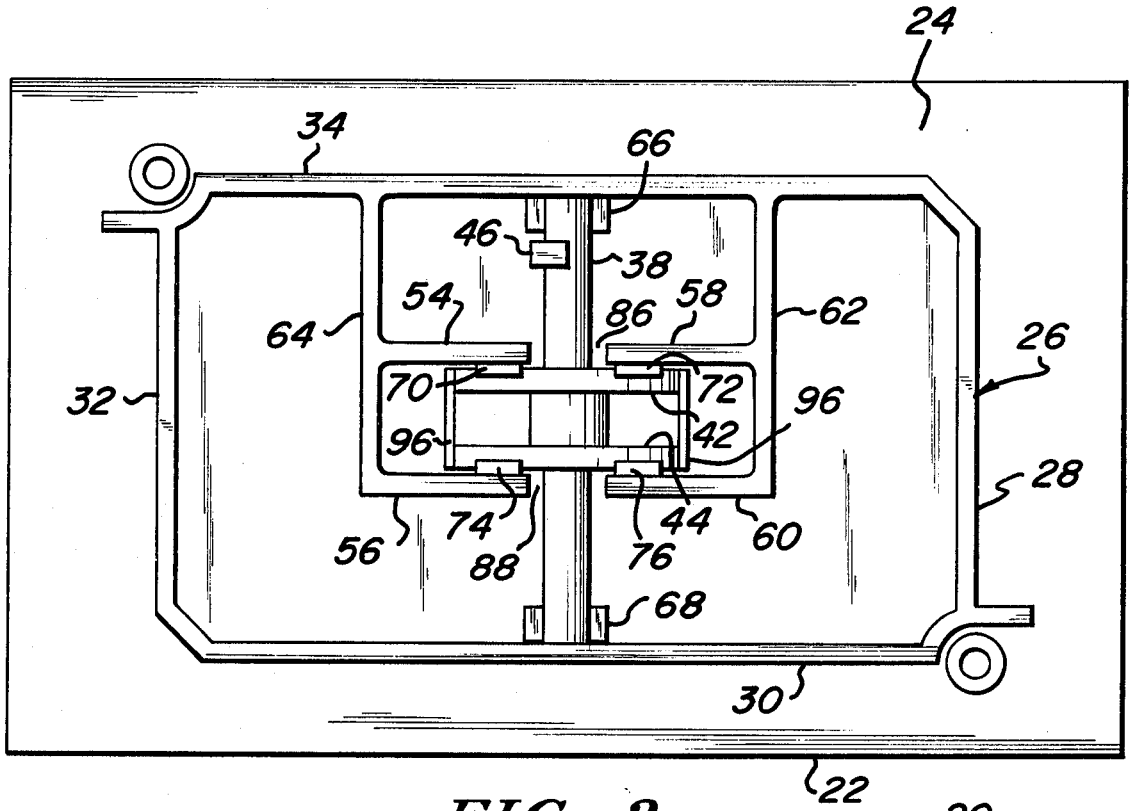
FIG. 2 is rear plan view showing further details of the assembly of FIG. 1.
Figure 3:
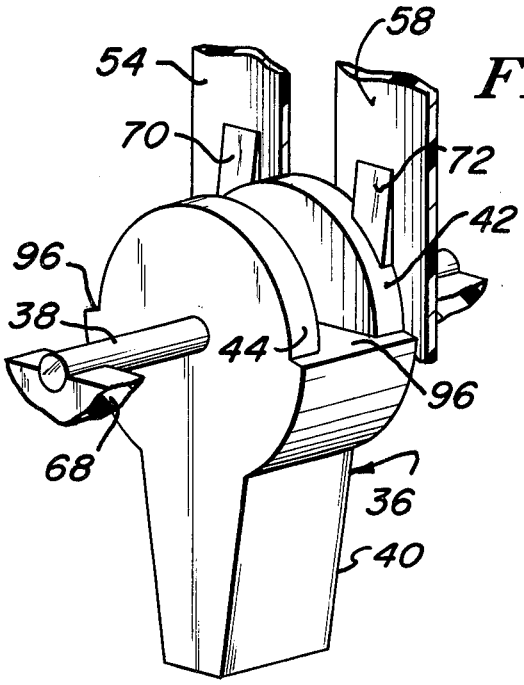
FIG. 3 is a fragmentary perspective view, partly in section, showing a portion of the assembly of FIG. 1.
Figure 4:
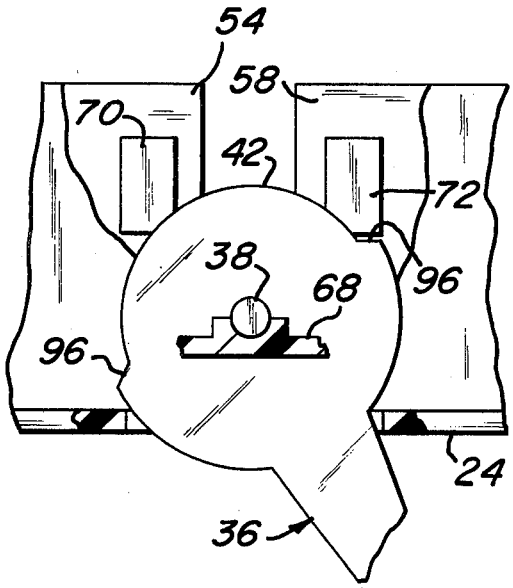
FIG. 4 is a fragmentary side elevational view, partly in section and partly cut away, of a portion of the assembly of FIG. 1.
Figure 5:
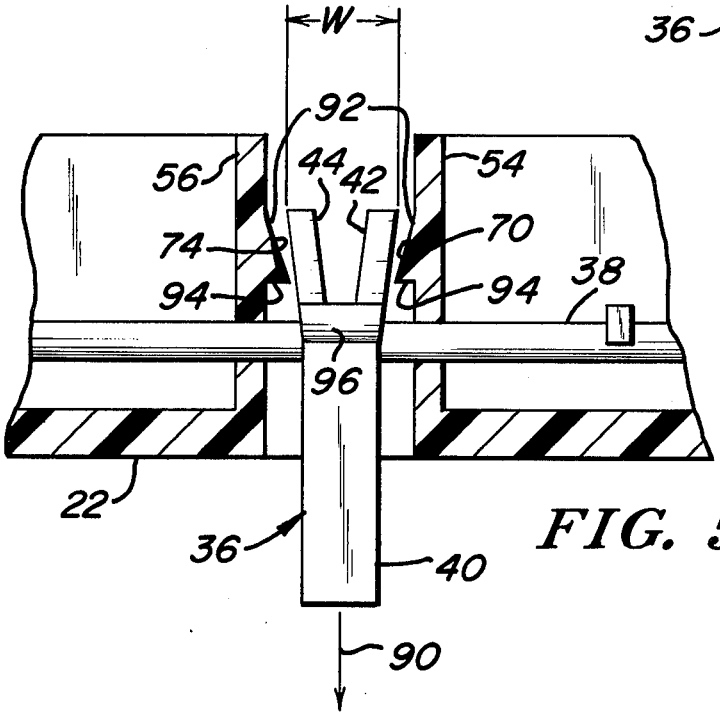
FIG. 5 is a fragmentary top plan view, partly in section, showing a step in the assembly of a toggle lever within a bearing arrangement constructed in accordance with the concepts of the invention.
Figure 6:
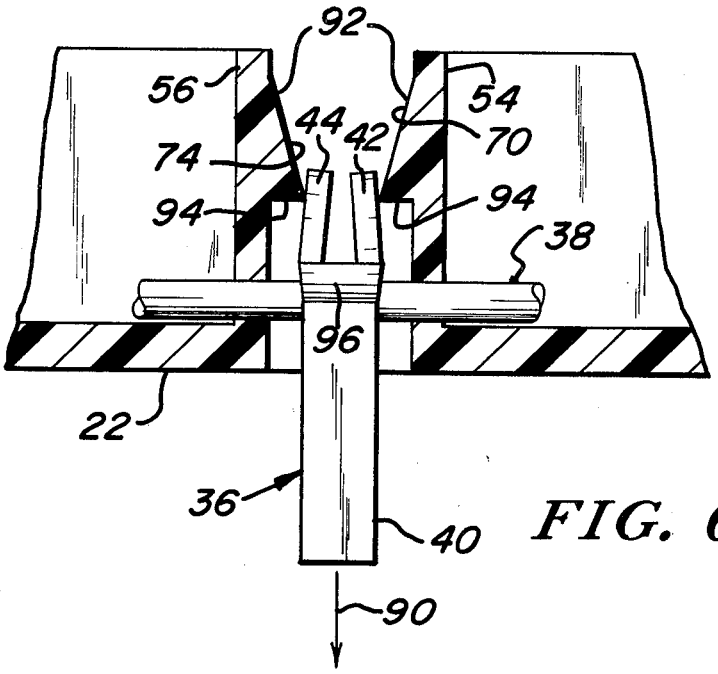
FIG. 6 is a fragmentary top plan view, partly in section, showing the toggle lever of FIG. 5 in an advanced state of assembly.
Figure 9:
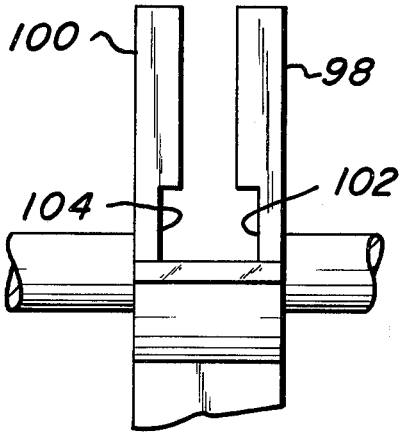
FIGS. 9 and 10 are fragmentary top plan views of further embodiments of a toggle lever for use in conjunction with a bearing arrangement constructed in accordance with the concepts of the invention.
Figure 10:
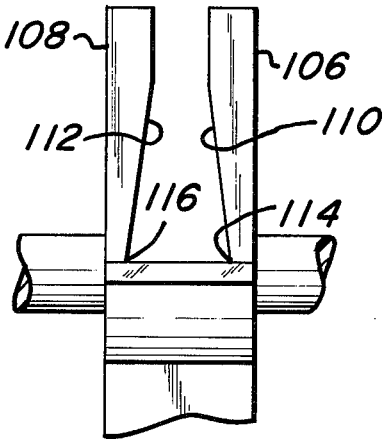
Figure 12:
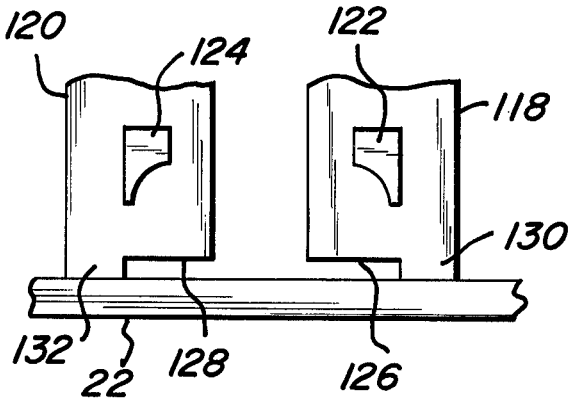
FIG. 12 is a fragmentary side elevational view of a further embodiment of bearing supporting sidewalls for a bearing arrangement constructed in accordance with the concepts of the invention.

Referring now to FIGS. 5 and 6, the toggle member 36 may be quickly and easily assembled to the wiring device 20 by, firstly, placing the toggle member 36 above the base portion 22 so that the shaft portion 38 is aligned with the first bearing elements 66 and 68 (FIG. 2). As will be seen in FIG. 2, the sidewalls 54 and 58 are separated by a slotted opening 86, while the sidewalls 56 and 60 are separated by a similar slotted opening 88. The openings 86 and 88 are located along an axis bisecting the first bearing elements 66 and 68 to provide clearance for the shaft portion 38. The arcuate segments 42 and 44 are positioned intermediate the sidewalls 54, 56, 58, ad 60 and above the second bearing elements 70, 72, 74, and 76, only bearing elements 70 and 74 being shown in the sectional views in FIGS. 5 and 6. The toggle member 36 is then urged downwardly in the direction shown by the arrow 90. As further shown in FIGS. 1, 5, and 6 with respect to second bearing elements 70 and 74, although elements 72 and 76 are similarly constructed, each second bearing element is formed with an inclined outer surface 92 converging towards the opposing second bearing element so that the spacing between each pair of opposing second bearing elements such as 70 and 74 narrows to a minimum dimension at the lowermost end of the surfaces 92, as viewed in FIGS. 5 and 6. There is then provided a stepped portion defining a bearing surface 94 arranged to engage the outer peripheral surface of a corresponding arcuate segment 42, 44. In their relaxed or initial position, the arcuate segments 42 and 44 are arranged so that the width W between the outermost surfaces of the segments 42 and 44 is greater than the minimum spacing between the inclined surfaces 92, providing an interference therebetween. Accordingly, to assemble the toggle member 36 between the first and second bearing elements it is necessary to exert sufficient pressure thereon in the direction indicated by the arrow 90 to cause the arcuate segments 42 and 44 to deflect inwardly slightly, as shown in FIG. 6, to pass between the surfaces 92. After clearing the surfaces 92, the arcuate segments 42 and 44 are then free to return to their initial or relaxed position, substantially as shown in FIG. 1, whereby the outer periphery of each arcuate segment 42, 44 is directly adjacent a set of corresponding second bearing elements 70, 72, and 74, 76, respectively. At the same time, the outer ends of the shaft portion 38 are received in the recesses of the first bearing elements 66 and 68 so that the toggle member 36 is fully restrained in position but nevertheless free to selectively rotate about the central axis of the shaft portion 38. The toggle member 36 may be further provided with stop means such as shoulder portions 96 (FIG. 4) extending outwardly from the terminating ends of the periphery of the arcuate segments 42 and 44. The shoulder portions 96 are angularly located with respect to the desired arc of travel of the toggle member 36 so as to abut the respective bearing surfaces 94 and limit the rotation of the toggle member 36 to an angle defined by the arc encompassed by the two shoulder portions 96. The arcuate segments 42 and 44 may be modified as shown in FIGS. 9 and 10 to permit them to be more readily deflected for insertion between the respective second bearing elements. In FIG. 9 there is shown a pair of arcuate segments 98 and 100 similar to segments 42 and 44 but having a notched portion 102, 104, respectively, adjacent the juncture between the segments 98 and 100 and the remainder of the toggle member, for reducing the cross section thereat and, consequently, the force required to elastically deflect the arcuate segments 98 and 100 during assembly. A similar result may be obtained by providing an embodiment as shown in FIG. 10 wherein arcuate segments 106 and 108 are each progressively narrowed, in cross section, as at 110 and 112, respectively, to provide an attachment web of minimum cross section as at 114 and 116, respectively, at the juncture between the segments 106 and 108 and the remainder of the toggle member. In any case it should be understood that the sidewalls 54, 56, 58, and 60, on which the second bearing elements 70, 72, 74, and 76 are located, being cantileveredly supported upon the basic portion 22 of the wiring device 20, will exhibit some degree of deflection upon the insertion of the toggle member arcuate segments 42 and 44 into its final position. In fact, according to the relative stiffness of the arcuate segments 42 and 44 in comparison with the stiffness of the sidewalls 54, 56, 58, and 60 in a particular structure, the sidewalls may be arranged to deflect outwardly sufficiently to permit the arcuate segments 42 and 44 to traverse the respective second bearing elements 70, 72, 74, and 76 without any noticeable deflection of the segments 42 and 44. Or, the parts may be suitably dimensioned so that both the sidewalls 54, 56, 58, and 60 and the arcuate segments 42 and 44 deflect slightly in opposite directions during the assembly procedure. To provide increased deflectability of the second bearing element supporting sidewalls, where necessary or desirable, an arrangement similar to that shown in FIG. 12 may be employed wherein a pair of juxtaposed sidewalls 118 and 120, similar to sidewalls 54 and 58, for example, and having thereon respective second bearing elements 122 and 124 similar to elements 70 and 72, are undercut, as at 126 and 128 so that a relatively narrow web portion 130, 132, respectively, serves to couple the respective sidewalls 118 and 120 to the base portion 22, thereby increasing the deflectability of the sidewalls 118 and 120.

Figure 11:
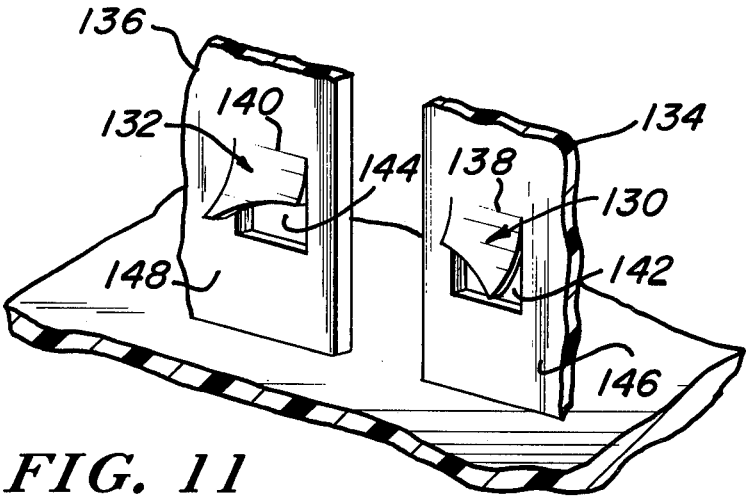
FIG. 11 is a fragmentary perspective view, partly in section, of a further embodiment of a portion of a bearing arrangement constructed in accordance with the concepts of the invention.

Turning now to FIG. 11, there is shown a further embodiment of second bearing elements 130 and 132 located on corresponding sidewalls 134 and 136, respectively. The elements 130 and 132 differ from their counterparts 70, 72, 74, and 76 in that, instead of being formed as immovable solid protuberances, are hingedly coupled to their corresponding sidewalls 134 and 136, as at 138 and 140, and are free to deflect inwardly towards the corresponding openings 142 and 144 in the respective sidewalls 134 and 136. In this arrangement, the second bearing elements such as 130 and 132 may provide the total deflection necessary to accommodate the toggle member 36 during the assembly operation. The bearing elements 130 and 132, although shown as extending forwardly of the respective adjacent surfaces 146 and 148 of the supporting sidewalls 134 and 136 for immediate engagement with the arcuate segments 42 and 44, may be initially disposed either within the respective openings 142 and 144, or rearwardly thereof out of initial interference with the arcuate segments 42 and 44 prior to the insertion of the toggle member 36 within the supporting structure and thereafter repositioned, substantially as shown in FIG. 11, for engagement with the appropriate peripheral surfaces of the arcuate segments 42 and 44.

Figure 13:
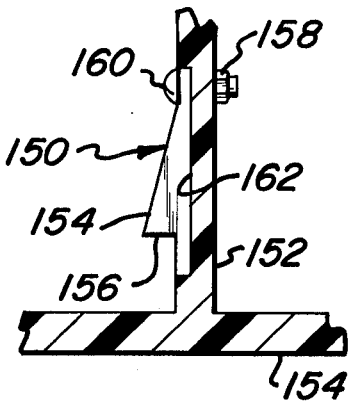
FIG. 13 is a fragmentary side elevational view, partly in section, of a further embodiment of a bearing arrangement constructed in accordance with the concepts of the invention.

In FIG. 13 there is shown a further embodiment of a discrete second bearing element 150 coupled to a supporting sidewall 152 which is formed integrally with a base portion 154 similar to the base portion 22 described above. As shown, the bearing element 150 is provided with an inclined outer surface 154 and a stepped portion defining a bearing surface 156, surfaces 154 and 156 corresponding generally to the surfaces 92 and 94 described above. The element 150, however, is assembled to the sidewall 152 by a mounting means shown, by way of example, as a threaded nut 158 and screw 160. Although not essential, the bearing element 150 is shown seated partially within a recess 162 in the sidewall 152 to provide a smoother transition between the element 150 and the adjacent surface of the sidewall 152. The bearing element 150 may thus be attached to the sidewall 150 either prior or subsequent to the placement of the toggle member 36 within the supporting structure.

It should be appreciated that the foregoing description, although relating to a rotatable element such as a toggle member for an electrical or wiring device, is not intended to be limited thereby, and that the invention may be utilized in connection with other devices in which a rotatable member is to be retained within a plurality of bearing surfaces located in an integral structure.

The embodiments of the invention in which an exclusive property or privilege is claimed are defined as follows:

1. Bearing means for a rotatable member having an elongate shaft portion and an enlarged arcuate portion, said enlarged arcuate portion being affixed to said shaft portion so as to have an axis of rotation coincident with the shaft portion axis, comprising: a generally planar base portion; spaced first bearing elements located on said base portion and having open recesses therein for slidingly receiving and supporting such shaft portion; selectively spaced sidewalls extending from said base portion generally normal to the plane of said base portion and spaced from said first bearing elements; and second bearing elements located on said sidewalls and spaced above said base portion to slidingly engage such enlarged arcuate portion of such rotable member as such shaft portion is seated within said first bearing elements, said sidewalls being located generally adjacent either side of such enlarged arcuate portion, said sidewalls being affixed to said base portion in cantilever fashion, said sidewalls being elastically deflectable about the juncture between said sidewalls and said base portion.

2. Bearing means as defined in claim 1 wherein said sidewalls each have an elongate slot separating each of said sidewalls into at least two discrete sidewall portions.

3. Bearing means as defined in claim 2 wherein at least one of said second bearing elements is disposed on each of said sidewall portions.

4. Bearing means as defined in claim 2 wherein each of said sidewall portions is independently deflectable.

5. In a wiring device of the type having a housing containing switch contacts therein, the improvement comprising: an integral structure including a generally planar base portion and selectively spaced sidewalls extending generally normal to the plane of said base portion, said base portion and said sidewalls forming at least a portion of said housing; a toggle member for actuating said switch contacts, said toggle member comprising an elongate shaft portion having means thereon for actuating said switch contacts, an enlarged arcuate portion affixed to said shaft portion so as to have an axis of rotation generally coincident with the shaft portion axis, and a handle portion extending outwardly from said enlarged arcuate portion generally normal to the central axis of said shaft portion for manipulating said toggle member; spaced first bearing elements located on said base portion and having open recesses therein slidingly receiving and supporting said shaft portion; and second bearing elements located on said sidewalls and spaced above said base portion, said second bearing elements slidingly engaging said enlarged arcuate portion of said toggle member, said toggle member being restrained between said first and said second bearing elements.

6. The improvements as defined in claim 5 wherein said second bearing elements are formed integrally with respective ones of said sidewalls.

7. The improvement as defined in claim 5 wherein said second bearing elements comprise discrete parts mounted on respective ones of said sidewalls.

8. The improvement as defined in claim 5 wherein said sidewalls are each independently cantileveredly mounted on said base portion.

9. The improvement as defined in claim 5 wherein said enlarged arcuate portion comprises a pair of spaced parallel arcuate segments defining said arcuate portion.

10. The improvement as defined in claim 9 wherein each of said arcuate segments comprises an area of reduced cross section adjacent said shaft portion.

* * * * *